US007968509B2

(12) United States Patent
Ozeki et al.

(10) Patent No.: US 7,968,509 B2
(45) Date of Patent: Jun. 28, 2011

(54) SOFTENING DETERGENT COMPOSITION COMPRISING A GLYCERYL MONOETHER

(75) Inventors: Yohei Ozeki, Wakayama (JP); Teruo Kubota, Wakayama (JP); Takanori Kotera, Wakayama (JP); Motomitsu Hasumi, Wakayama (JP)

(73) Assignee: Kao Corporation, Tokyo (JP)

( * ) Notice: Subject to any disclaimer, the term of this patent is extended or adjusted under 35 U.S.C. 154(b) by 164 days.

(21) Appl. No.: 12/225,383

(22) PCT Filed: Mar. 29, 2007

(86) PCT No.: PCT/JP2007/057617

§ 371 (c)(1),
(2), (4) Date: Dec. 19, 2008

(87) PCT Pub. No.: WO2007/114484

PCT Pub. Date: Oct. 11, 2007

(65) Prior Publication Data

US 2010/0298199 A1 Nov. 25, 2010

(30) Foreign Application Priority Data

Mar. 31, 2006 (JP) ..... 2006-096286

(51) Int. Cl.
*C11D 1/83* (2006.01)
*C11D 3/08* (2006.01)

(52) U.S. Cl. ..... 510/515; 510/276; 510/287; 510/308; 510/316; 510/322; 510/327; 510/334; 510/353; 510/355; 510/356; 510/399; 510/437; 510/481; 510/491; 510/507

(58) Field of Classification Search ..... 510/276, 510/287, 308, 316, 322, 327, 334, 353, 355, 510/356, 399, 437, 481, 491, 507, 515
See application file for complete search history.

(56) References Cited

U.S. PATENT DOCUMENTS

| | | | | |
|---|---|---|---|---|
| 4,062,647 | A | 12/1977 | Storm et al. | |
| 4,430,237 | A | 2/1984 | Pierce et al. | |
| 5,209,857 | A | 5/1993 | Kenyon et al. | |
| 5,300,236 | A | 4/1994 | Bortolotti et al. | |
| 5,332,513 | A | 7/1994 | Doms et al. | |
| 5,560,904 | A * | 10/1996 | Laugier et al. | 424/78.08 |
| 5,780,424 | A * | 7/1998 | Pineau et al. | 514/2.4 |
| 6,641,618 | B1 * | 11/2003 | Legrand et al. | 8/101 |
| 2002/0006420 | A1 * | 1/2002 | Philippe et al. | 424/401 |
| 2003/0105169 | A1 * | 6/2003 | Lennon | 516/53 |
| 2005/0181257 | A1 * | 8/2005 | Jung et al. | 429/33 |
| 2005/0271609 | A1 * | 12/2005 | Fei et al. | 424/65 |

FOREIGN PATENT DOCUMENTS

| | | | |
|---|---|---|---|
| DE | 19959000 | A1 | 6/2001 |
| EP | 0 570 237 | A2 | 11/1993 |
| EP | 0 611 392 | | 8/1994 |
| JP | 49-85102 | A | 8/1974 |
| JP | 2-53898 | A | 2/1990 |
| JP | 2-145858 | A | 6/1990 |
| JP | 05-140869 | A | 6/1993 |
| JP | 7-500861 | A | 1/1995 |
| JP | 08-506843 | A | 7/1996 |
| JP | 2001-40392 | A | 2/2001 |
| JP | 2002-249799 | A | 9/2002 |
| JP | 2002-541342 | A | 12/2002 |
| JP | 2005-187998 | A | 7/2005 |
| WO | WO-94/19440 | A1 | 9/1994 |
| WO | WO-00/60039 | A1 | 10/2000 |

OTHER PUBLICATIONS

Office Action in China Patent Application No. 200780010713.4 mailed May 7, 2010.
Partial English translation of "Known and Customary Technological Collection (Powder detergents for clothes)," Official gazette, 10 (1998)-25 [7159] published by Japanese Patent Office.
Chinese Application No. 200780010713.4; Chinese Office Action, mailed Nov. 1, 2010, 4 pages.
Chinese Application No. 200780010713.4, Chinese Office Action, Feb. 23, 2011, pp. 1-4.

* cited by examiner

*Primary Examiner* — Charles I Boyer
(74) *Attorney, Agent, or Firm* — Birch, Stewart, Kolasch & Birch, LLP

(57) ABSTRACT

The present invention relates to a softening detergent composition containing a glyceryl monoether represented by formula (I) and (b) a clay mineral:

$$R—O—(C_3H_6O_2)_n—H \quad (I)$$

wherein R represents a hydrocarbon group having 6 to 22 carbon atoms and n represents the degree of condensation of glycerin and denotes a number from 3 to 5.

7 Claims, No Drawings

SOFTENING DETERGENT COMPOSITION COMPRISING A GLYCERYL MONOETHER

FIELD OF THE INVENTION

The present invention relates to a softening detergent composition.

BACKGROUND OF THE INVENTION

Studies have been made to formulate a softening base agent in a detergent to prevent washed fiber products from losing softness into ones having a stiff feel caused by, for example, the elimination of a fiber treating agent and the adsorption of salts. For example, it has been known to formulate a clay mineral such as smectites (see, for example, JP-A 49-85102), a cationic surfactant such as a dialkyl type quaternary ammonium salt (see, for example, Publication of The Patent Office, Known and Customary Technological Collection (Powder detergents for clothes), published on Mar. 26, 1998) or silicon such as polydimethylsiloxane (for example, JP-A 2002-249799).

Also, studies have recently made as to a method of reinforcing the softening effect given by a clay mineral from the viewpoint of for example, formulating with ease and environment response. For example, it has been known to combine bentonite and a pentaerythritol compound (see, for example, JP-A 5-140869), a clay mineral and a coagulant (see, for example, JP-A 2002-541342) and bentonite and a soluble potassium salt (see, for example, JP-A 8-506843.

SUMMARY OF THE INVENTION

The present invention relates to a softening detergent composition containing (a) a glyceryl monoether (hereinafter referred to as a component (a)) represented by formula (I) and (b) a clay mineral (hereinafter referred to as a component (b)).

$$R—O—(C_3H_6O_2)_n—H \quad (I)$$

In formula (I), R represents a hydrocarbon group having 6 to 22 carbon atoms and n represents the degree of condensation of glycerin and denotes a number from 3 to 5.

DETAILED DESCRIPTION OF THE INVENTION

Detergent technologies have not reached a stage in which sufficient softness is imparted in a washing process in recent years in which there is an increased demand for detergents having the ability to impart softness to fibers. Moreover, a nonionic surfactant have come to be formulated as a main surfactant in recent years as one of measures taken to strengthen detergency and particularly detergency to oil stains. It has been however clarified that when a nonionic surfactant and particularly, polyoxyethylene type nonionic surfactant is present in a detergent compounded with a clay mineral, it is more difficult to improve softening ability.

The present invention relates to a softening detergent composition which is superior in the ability to clean fiber products and also can impart a good softening effect to fiber products.

When the softening detergent composition of the present invention is used, a high detergency is obtained and can also impart an excellent softness to fiber products when fiber products and the like are washed.

<Component (a)>

Component (a) in the present invention is a glyceryl monoether obtained by combining one hydrocarbon group having 6 to 22 carbon atoms with polyglycerin which is a condensate of glycerin by an ether bond.

In glyceryl monoethers having a degree n of glycerin condensation of 1 to 7 of component (a), the total content of glyceryl monoethers having a degree n of glycerin condensation of 3 to 5 is preferably 40% by weight or more, more preferably 50% by weight or more and even more preferably 60% by weight or more.

The degree n of glycerin condensation is preferably 3 or 4, more preferably 4, from the viewpoint of detergency. Also, in glyceryl monoethers having a degree n of glycerin condensation of 1 to 7 of component (a), the total content of glyceryl monoethers having a degree n of glycerin condensation of 3 to 4 is preferably 70% by weight or more.

Glyceryl monoethers having a degree n of 3 to 5 of component (a) may be included in glyceryl monoethers having a degree of glycerin condensation of 3 to 8 or 1 to 7.

R in formula (I) may be any of straight-chain, branched, saturated and unsaturated hydrocarbon groups, is an alkyl group having preferably 6 to 22, more preferably 12 to 14 and even more preferably 12 carbon atoms and is even more preferably a straight-chain alkyl group. In component (a), the total content of compounds represented by formula (I) in which R is an alkyl group having 12 to 14 carbon atoms is preferably 70% by weight or more and more preferably 80% by weight or more.

Component (a) in the present invention is obtained by reacting a specified amount of 2,3-epoxy-1-propanol (glycidol) with an alcohol having 6 to 22 carbon atoms in the presence of an alkali catalyst. It may also be produced using such a method described in JP-A 2000-160190, Paragraph 0007-0011.

As the combined form of glycerin in component (a), there are a linear type (glycerins are combined at the first and third positions) and branched type (for example, glycerins are combined at the first and second positions and glycerins are combined at the first and third positions of glycerins (on the side of the second position) combined at the first and second positions). Though compounds having any of these combined forms may be used, particularly a linear compound represented by formula (I) in which the $C_3H_6O_2$ groups are linearly combined with each other is preferable.

Generally, the glyceryl monoether like component (a) is obtained as a mixture of compounds differing in the degree of condensation. In the present invention, compounds having a degree n of glycerin condensation of 3 to 5 are used from the viewpoint of detergency. However, the above mixture may be used as it is if it contains these compounds. Moreover, it is preferable to obtain compounds having a degree n of condensation falling in the above range by refining the reaction product by distillation or the like according to the need. In such a mixture, the total content of glycerin monoethers having a degree n of glycerin condensation of 1 or 2 is preferably less than 20% by weight. Moreover, the total content of glycerin monoethers having a degree n of glycerin condensation of 1 is preferably less than 10% by weight.

The content of component (a) is preferably 0.1 to 80% by weight, more preferably 1 to 50% by weight, even more preferably 3 to 25% by weight and even more preferably 5 to 20% by weight in the softening detergent composition of the present invention.

<Component (b)>

The softening detergent composition of the present invention contains a clay mineral as component (b). The content of component (b) in the softening detergent composition is preferably 3 to 30% by weight, more preferably 3 to 20% by weight, even more preferably 4 to 18% by weight, even more preferably 6 to 16% by weight and even more preferably 8 to 15% by weight from the viewpoint of softening ability and detergency.

The clay mineral, particularly in the case where it is natural products, includes impurities such as quartz, cristobalite, calcite and feldspar. Therefore, the content of component (b) is one excluding the content of these impurities. Also, the content of the water, binder and additives supplied in a granulation process is excluded from the content of component (b).

Examples of component (b) include, though not particularly limited to, talc, pyrophillite, smectites (for example, saponite, hectrite, sokonite, stevensite, montmorillonite, beidellite and nontronite), vermiculite, mica (for example, gold mica, black mica, zinnwaldite, white mica, paragonite, celadonite and glauconite), chlorites (for example, clinochlore, chamosite, nimite, penantite, sudoite and donbassite), brittle mica (for example, clintonite and margarite), suelite, serpentine minerals (for example, antigorite, lizardite, chrysotile, amesite, cronstedtite, burcherin, greenalite and garnierite) and kaolin minerals (for example, kaolinite, dickite, nacrite and halloysite). Among these compounds, talc, smectites, swellable mica, vermiculite, chrysotile, kaolin minerals and the like are preferable, smectites are more preferable and montmorillonite is even more preferable from the viewpoint of softening ability. These compounds may be used either singly or in proper combinations of two or more.

Also, as component (b), a smectite type clay mineral represented by the following formula (II) may be preferably used.

$$[Si_a(Mg_nAl_b)O_{20}(OH)_4]^{X-}.X/n[Me]^{n+} \quad (II)$$

In formula (II), $0<a\leqq 6$, $0\leqq b\leqq 4$, $0.2\leqq X=12-2a-3b\leqq 1.2$, Me represents at least one type among Na, K, Li, Ca, Mg and $NH_4$ and n denotes the valence number of Me.

As component (b), either a powder of the clay mineral or a clay granule containing the clay mineral as its major component may be used. When the powder is used as component (b), the particle diameter of the powder is preferably 0.1 to 30 μm from the viewpoint of oil absorbing ability and swelling ability. When the granule is used as component (b), the particle diameter of the granule is preferably 100 to 2000 μm from the viewpoint of solubility.

The clay mineral usually includes impurities such as quartz, cristobalite, calcite and feldspar. Therefore, the content of component (b) includes these impurities. Also, the content of components including the water, binder and additives supplied in a granulation process is included in the content of component (b).

Also, when the clay granule is used as component (b), the ratio by weight of Na/Ca in the granule may be changed according to use. When the ratio by weight of Na/Ca is changed to 1 or more, the dispersibility of the granule can be improved whereas when the ratio is changed to less than 1, softness when clothes are washed can be improved.

The ratio by weight of component (a) to component (b) to be formulated, namely component (a)/component (b) is preferably 0.5/20 to 30/3 and more preferably 1/15 to 20/5 from the viewpoint of preparation.

<Component (c)>

Moreover, the softening detergent composition of the present invention may contain an anionic surfactant (excluding fatty acid salts) as a component (c) in view of detergency and softening ability. The content of component (c) in the softening detergent composition is preferably 6 to 27% by weight, more preferably 10 to 26% by weight, even more preferably 12 to 25% by weight, even more preferably 16 to 25% by weight and even more preferably 20 to 25% by weight in view of softening ability and detergency.

Examples of component (c) may include, though not particularly limited to, sulfates of alcohols having 10 to 18 carbon atoms, sulfates of alkoxylated products of alcohols having 8 to 20 carbon atoms, alkylbenzene sulfonates, paraffin sulfonates, α-olefin sulfonates, α-sulfofatty acid salts and α-sulfofatty acid alkyl esters. In the present invention, component (c) preferably contains straight-chain alkylbenzene sulfonates in which the number of carbons of the alkyl chain is 10 to 14 and more preferably 12 to 14 carbon atoms or alkyl sulfates in which the number of carbon atoms of the alkyl chain is 10 to 18 in particular. As the counter ion, alkali metal salts or amines are preferable and particularly sodium and/or potassium, monoethanolamine and diethanolamine are preferable.

Also, a mixture system of an alkyl benzene sulfonate and an alkyl sulfate is more preferable, wherein the ratio by weight of the alkyl benzene sulfonate and the alkyl sulfate is even more preferably 30/1 to 1/1 and even more preferably 5/1 to 6/5. Moreover, the ratio of branched chain/straight-chain of the alkyl group of the alkyl sulfate is preferably 10/90 to 99/1, more preferably 20/80 to 97/3, even more preferably 30/70 to 95/5 and even more preferably 40/60 to 90/10 from the viewpoint of softening ability.

A surfactant other than component (c) may be contained. In the present invention, the ratio by weight of component (a)/all surfactants is preferably 1/10 to 1/1, more preferably 1/4 to 1/1 and even more preferably 1/2 to 1/1 in view of softening ability. In the calculation of this ratio by weight, the term "all surfactants" means that component (a) is included.

<Component (d)>

Moreover, the softening detergent composition of the present invention preferably contains an alkali agent in an amount of 10 to 25% by weight as a component (d). Examples of component (d) may include (d1) carbonates, (d2) crystalline silicates and (d3) amorphous silicates. With regard to each content of these components in the composition, the content of component (d1) is preferably 12 to 24% by weight from the viewpoint of detergency, the content of component (d2) is preferably 0.5 to 3% by weight and more preferably 0.5 to 2% by weight from the viewpoint of softening ability and the content of component (d3) is preferably 5% by weight or less from the viewpoint of detergency and softening ability.

<Component (e)>

Also, the softening detergent composition of the present invention contains a fatty acid salt in an amount of preferably 0.3 to 3% by weight, more preferably 0.4 to 2% by weight and even more preferably 0.5 to 1.5% by weight as component (e) from the viewpoint of softening ability.

Examples of the fatty acid include fatty acids having 10 to 22 carbon atoms. The number of carbons is preferably 10 to 18. As the salt, salts of alkali metals such as sodium and potassium are preferable and a sodium salt is more preferable.

<Component (f)>

Also, the softening detergent composition of the present invention contains a polyhydric alcohol in an amount of preferably 0.1 to 10% by weight, more preferably 0.2 to 6% by weight, even more preferably 0.4 to 4% by weight and even more preferably 0.6 to 3% by weight as a component (f) from the viewpoint of softening ability and solubility.

As component (f), compounds having two or more hydroxyl groups in the molecule are preferable. Also, the polyhydric alcohol as component (f) has a melting point of preferably 40° C. or less, more preferably 30° C. or less and even more preferably 20° C. or less. The melting point can be measured by the visual method in JIS K0064-1992 "Method of Measuring Melting Point and Melting Range of Chemical Products".

As component (f), glycerin and/or polyethylene glycol are preferable.

<Water Content>

The softening detergent composition of the present invention contains water (water content measured by the heating loss method described in JIS K 3362: 1998) in an amount of preferably 0.1 to 10% by weight, more preferably 0.2 to 6% by weight and even more preferably 0.5 to 4% by weight.

<Other Components>

The softening detergent composition of the present invention may contain builders known in the fields of clothes (for example, an amorphous alumino silicate, sodium tripolyphosphate and sodium pyrophosphate, and organic builders including aminocarboxylate, hydroxyaminocarboxylate, hydroxycarboxylate, cyclocarboxylate, ether carboxylate and organic carbonic acid (salt) polymer), recontamination preventive agents (for example, polyacrylates and carboxymethyl cellulose), other softening agents, fluorescent dyes, antifoaming agents (for example, soaps and silicone), enzymes (for example, protease, cellulase, amylase and lipase), enzyme stabilizers, colorants and perfumes.

The softening detergent composition of the present invention having the above composition may be produced by blending the above each component by a known method and may be surface-modified using a surface modifier in view of fluidity and anti-caking characteristics.

The softening detergent composition of the present invention is used in the form of, preferably a powder or a tablet and more preferably a powder in view of stability. The average particle diameter of the softening detergent composition which is found from the grain size measured by the screening method using the screening machine described in JIS K3362: 1998 is preferably 200 to 1000 μm, more preferably 250 to 900 μm and even more preferably 300 to 800 μm from the viewpoint of low-temperature solubility and stability. The apparent density of the softening detergent composition which is measured by the method described in JIS K 3362: 1998 is preferably 300 to 1200 g/L, more preferably 400 to 1100 g/L, even more preferably 600 to 1000 g/L and even more preferably 700 to 980 g/L from the viewpoint of low-temperature solubility and stability.

The pH of an aqueous 0.1 wt % solution of the softening detergent composition of the present invention which is measured at 20° C. according to JIS K3362: 1998 is preferably 8 to 12, more preferably 9 to 11.5, even more preferably 9.5 to 11 and even more preferably 10 to 11 from the viewpoint of detergency, softening ability and scratch resistance.

The amount of calcium sequestered by the softening detergent composition and measured in the following measuring method is preferably 20 to 300 $CaCO_3$ mg/g, more preferably 50 to 200 $CaCO_3$ mg/g and even more preferably 100 to 150 $CaCO_3$ mg/g in view of detergency and softening ability.

(Method of Measuring the Amount of Sequestered Calcium)

The amount of sequestered calcium (sequestered Ca amount) is found by the method described in JP-A3-277696, page 3, right lower column, line 6 to page 4, upper right column, line 6 (provided that the term "anionic surfactant" is replaced with the term "softening detergent composition").

The softening detergent composition of the present invention may be preferably used as softening detergents for fiber products such as clothes typified by cotton towels, bath towels, T-shirts and sweat shirts.

EXAMPLES

The following examples are for explaining the embodiments of the present invention. These examples are for exemplifying the present invention and are not intended to be limiting of the present invention.

Synthetic Examples

A 300 mL four-neck flask was charged with 93.2 g (0.50 mol) of lauryl alcohol and 7.01 g (0.10 mol) of potassium methoxide and the mixture was raised to 95° C. under a reduced pressure of 25 kPa with stirring to distill methanol. Then, 148.16 g (2.0 mol) of glycidol was added dropwise to the mixture at 95° C. in a nitrogen stream for 24 hours and the resulting mixture was stirred continuously for 2 hours under this condition. After the reaction was finished, 4.90 g (0.05 mol) of sulfuric acid and 10 g of water were added to the reaction solution to neutralize the catalyst, thereby obtaining 248.1 g (conversion rate of glycidol: 99.9% or more) of a reaction intermediate. In the obtained reaction intermediate, the existence of polyglycerin lauryl ether was confirmed by a gas chromatographic method, wherein the ratio of the amount of compounds having a degree n of glycerin condensation of 3 to 5 to the total amount of compounds having a degree n of glycerin condensation of 1 to 7 was 28.6% by weight. The obtained reaction product was analyzed by gas chromatography and as a result, lauryl alcohol, lauryl monoglyceryl ether, lauryl diglyceryl ether, glycerin and polyglycerin were not detected. Also, in the resulting lauryl polyglyceryl ether, the ratio of the amount of compounds having a degree n of glycerin condensation of 3 to 5 to the total amount of compounds having a degree n of glycerin condensation of 1 to 7 was 55.4% by weight. It was thus confirmed that the product (glyceryl monoether (1)) contained plural compounds differing in the degree n of glycerin condensation.

Preparation Examples

The mixture obtained in the above synthesis may be appropriately fractionated separately according to the degree of condensation to use the obtained fractions by combining them.

Examples 1 to 24, Comparative Examples 1 to 3

Each detergent base was obtained from components excluding the above clay mineral, enzyme, perfume and 3% by weight of surface-modifying zeolite from components shown in Table 1. The remainder components were blended in the detergent base to obtain a softening detergent composition. Each percentage composition of the softening detergent compositions is shown in Table 1.

Each obtained softening composition had the following characteristics when measured according to JIS K3362: 1998: the pH of an aqueous 0.1 wt % solution thereof was in a range from 10 to 11 at 20° C., the amount of calcium to be sequestered by it was in a range from 50 $CaCO_3$ mg/g to 200 $CaCO_3$ mg/g, its average particle diameter was in a range from 300 to 800 μm and each apparent density was in a range from 700 to 980 g/L.

The detergency and softening ability of each obtained softening detergent composition were evaluated according to the following formula. The results are shown in Table 1.

(I) Method of Evaluating Detergency (Preparation of Clothes with a Dirty Collar)

Clothes with a dirty collar were prepared according to JIS K3362: 1998.

(Detergent Condition and Evaluation Method)

The detergency of each softening detergent composition, shown in Table 1, was compared with that of a detergency-determining standard detergent according to the method of evaluation of the detergency of synthetic detergents for clothes according to JIS K 3362: 1998. The used concentration of each softening detergent composition shown in Table 1 was made to be 1.0 g/L.

Evaluation Standard

○: Superior to the standard detergent.

Δ: Equal to the standard detergent.

×: Inferior to the standard detergent.

(II) Method of Evaluating Softening Ability (Preparation of Towels for Evaluation)

Commercially available cotton towels (cotton: 100%) were washed using a mini-washing machine (trade name: "N-BK2"), manufactured by National). At this time, a pretreating agent obtained by mixing a nonionic surfactant (obtained by adding an average 6 mol of ethylene oxide to a primary alcohol having 12 carbon atoms), crystalline silicate (pre-feed granular product) and sodium carbonate in a ratio of 1/1/3 (ratio by weight) was used in an amount of 0.5 g/L. After towels were washed at a water temperature of 20° C. for 7 minutes, operations carried out in the order of centrifugal dewatering, in-water rinsing for 3 minutes, dewatering, in-water rinsing for 3 minutes and dewatering were repeated five times to remove the treating agent from them. The obtained towels were used for the following test.

(Softening Treatment)

5.0 g of each softening detergent composition shown in Table 1 and 0.3 kg (70 cm×30 cm, 4 towels) of the cotton towel were poured into 5 L of 20° C. water and washed for 7 minutes. After dewatered, the towels were subjected to an operation carried out using 5 L of water in the order of in-water rinsing for 3 minutes, dewatering, in-water rinsing for 3 minutes, dewatering and drying in the air.

The towel washed with the softening detergent composition and the pretreated towel were allowed to make a couple, and five judges functionally evaluated a soft feel to the touch. The case where there was no difference between the both or the case where the towel was hardened was rated as 0 point, the case where the towel was slightly softened was rated as 1 point, the case where the towel was softened a little was rated as 2 points and the case where the towel was softened distinctively was rated as 3 points, to show the total points of five judges as follows. At this time, 6 points or more, ○ or more, was rated as "pass".

Evaluation Standard

◎: the total point is 10 points or more.

○: the total point is 6 points or more and less than 10 points.

Δ: the total point is 3 points or more and less than 6 points.

×: the total point is less than 3 points.

TABLE 1

| | | | | Example | | | | | | | | | | | | | | | |
|---|---|---|---|---|---|---|---|---|---|---|---|---|---|---|---|---|---|---|---|
| | | | | 1 | 2 | 3 | 4 | 5 | 6 | 7 | 8 | 9 | 10 | 11 | 12 | 13 | 14 | 15 | 16 |
| Compounding component (% by weight) | A | (a) | a1 | 10 | | | | | | | | | | 20 | | 1 | 1 | 3 | 4 |
| | | | a2 | | 10 | 5 | 5 | 15 | 10 | 10 | 10 | 10 | 10 | | 20 | 7 | 8 | 4 | 3 |
| | | | a3 | | | | | | | | | | | | | 2 | 0.5 | 3 | |
| | | | a4 | | | | | | | | | | | | | | 0.5 | | 2 |
| | | | a5 | | | | | | | | | | | | | | | | 1 |
| | | | a6 | | | | | | | | | | | | | | | | |
| | | | a7 | | | | | | | | | | | | | | | | |
| | | (b) | Clay mineral 1 | 13 | 13 | 13 | 13 | 13 | 13 | 13 | 13 | 13 | 13 | 13 | 13 | 13 | 13 | 13 | 13 |
| | | | Clay mineral 2 | | | | | | | | | | | | | | | | |
| | | | Clay mineral 3 | | | | | | | | | | | | | | | | |
| | | | Clay mineral 4 | | | | | | | | | | | | | | | | |
| | | | Ethoxylate nonion | | | | 5 | | | | | | | | | | | | |
| | | (c) | LAS | 10 | 10 | 15 | 10 | 5 | | 5 | 9.5 | 5 | | | | 10 | 10 | 10 | 10 |
| | | | α-SFE | | | | | | 10 | 5 | | | | | | | | | |
| | | | AS | | | | | | | | 0.5 | 5 | 10 | | | | | | |
| | | (d) | Soda ash | 20 | 20 | 20 | 20 | 20 | 20 | 20 | 20 | 20 | 20 | 20 | 20 | 20 | 20 | 20 | 20 |
| | | | Crystalline silicate | 1 | 1 | 1 | 1 | 1 | 1 | 1 | 1 | 1 | 1 | 1 | 1 | 1 | 1 | 1 | 1 |
| | | (e) | Soap | 1 | 1 | 1 | 1 | 1 | 1 | 1 | 1 | 1 | 1 | 1 | 1 | 1 | 1 | 1 | 1 |
| | | (f) | PEG | 0.8 | 0.8 | 0.8 | 0.8 | 0.8 | 0.8 | 0.8 | 0.8 | 0.8 | 0.8 | 0.8 | 0.8 | 0.8 | 0.8 | 0.8 | 0.8 |
| | | | Zeolite | 23 | 24 | 23 | 23 | 23 | 23 | 23 | 23 | 23 | 23 | 23 | 23 | 23 | 23 | 23 | 23 |
| | | | Mirabilite | 14 | 13 | 14 | 14 | 14 | 14 | 14 | 14 | 14 | 14 | 14 | 14 | 14 | 14 | 14 | 14 |
| | | | Oligomer D | 5 | 5 | 5 | 5 | 5 | 5 | 5 | 5 | 5 | 5 | 5 | 5 | 5 | 5 | 5 | 5 |
| | | | Enzyme | 0.4 | 0.4 | 0.4 | 0.4 | 0.4 | 0.4 | 0.4 | 0.4 | 0.4 | 0.4 | 0.4 | 0.4 | 0.4 | 0.4 | 0.4 | 0.4 |
| | | | Perfume | 0.3 | 0.3 | 0.3 | 0.3 | 0.3 | 0.3 | 0.3 | 0.3 | 0.3 | 0.3 | 0.3 | 0.3 | 0.3 | 0.3 | 0.3 | 0.3 |
| | | | Water | 1.5 | 1.5 | 1.5 | 1.5 | 1.5 | 1.5 | 1.5 | 1.5 | 1.5 | 1.5 | 1.5 | 1.5 | 1.5 | 1.5 | 1.5 | 1.5 |
| (a)/A × 100 [%] | | | | 100 | 100 | 100 | 100 | 100 | 100 | 100 | 100 | 100 | 100 | 100 | 100 | 100 | 95 | 100 | 70 |
| Detergency | | | | ○ | ○ | ○ | ○ | ○ | ○ | ○ | ○ | ○ | ○ | ○ | ○ | ○ | ○ | ○ | ○ |
| Softening ability | | | | ◎ | ◎ | ○ | ○ | ◎ | ◎ | ◎ | ◎ | ◎ | ◎ | ◎ | ◎ | ◎ | ◎ | ◎ | ○ |

| | | | | Example | | | | | | | | Comparative example | | |
|---|---|---|---|---|---|---|---|---|---|---|---|---|---|---|
| | | | | 17 | 18 | 19 | 20 | 21 | 22 | 23 | 24 | 1 | 2 | 3 |
| Compounding com- | A | (a) | a1 | 1 | 1 | 1 | 1 | 1 | 1 | 1 | 1 | | | |
| | | | a2 | 4 | 3 | 3 | 7 | 7 | 7 | 7 | 7 | | | |
| | | | a3 | 2 | 2 | 1 | 2 | 2 | 2 | 2 | 2 | | | |

TABLE 1-continued

| | | | | | | | | | | | | | |
|---|---|---|---|---|---|---|---|---|---|---|---|---|---|
| ponent | | a4 | 1 | 1 | 1 | | | | | | 10 | | |
| (% by | | a5 | | 1 | 1 | | | | | | | 10 | |
| weight) | | a6 | 1 | 1 | 2 | | | | | | | | 5 |
| | | a7 | 1 | 1 | 1 | | | | | | | | 5 |
| | (b) | Clay mineral 1 | 13 | 13 | 13 | | | | 5 | 20 | 13 | 13 | 13 |
| | | Clay mineral 2 | | | | 13 | | | | | | | |
| | | Clay mineral 3 | | | | | 13 | | | | | | |
| | | Clay mineral 4 | | | | | | 13 | | | | | |
| | | Ethoxylate nonion | | | | | | | | | | | |
| | (c) | LAS | 10 | 10 | 10 | 10 | 10 | 10 | 10 | 10 | 10 | 10 | 10 |
| | | α-SFE | | | | | | | | | | | |
| | | AS | | | | | | | | | | | |
| | (d) | Soda ash | 20 | 20 | 20 | 20 | 20 | 20 | 25 | 17 | 20 | 20 | 20 |
| | | Crystalline silicate | 1 | 1 | 1 | 1 | 1 | 1 | 1 | 1 | 1 | 1 | 1 |
| | (e) | Soap | 1 | 1 | 1 | 1 | 1 | 1 | 1 | 1 | 1 | 1 | 1 |
| | (f) | PEG | 0.8 | 0.8 | 0.8 | 0.8 | 0.8 | 0.8 | 0.8 | 0.8 | 0.8 | 0.8 | 0.8 |
| | | Zeolite | 23 | 23 | 23 | 23 | 23 | 23 | 24 | 21 | 23 | 23 | 23 |
| | | Mirabilite | 14 | 14 | 14 | 14 | 14 | 14 | 16 | 12 | 14 | 14 | 14 |
| | | Oligomer D | 5 | 5 | 5 | 5 | 5 | 5 | 5 | 5 | 5 | 5 | 5 |
| | | Enzyme | 0.4 | 0.4 | 0.4 | 0.4 | 0.4 | 0.4 | 0.4 | 0.4 | 0.4 | 0.4 | 0.4 |
| | | Perfume | 0.3 | 0.3 | 0.3 | 0.3 | 0.3 | 0.3 | 0.3 | 0.3 | 0.3 | 0.3 | 0.3 |
| | | Water | 1.5 | 1.5 | 1.5 | 1.5 | 1.5 | 1.5 | 1.5 | 1.5 | 1.5 | 1.5 | 1.5 |
| (a)/A × 100 [%] | | | 70 | 60 | 50 | 100 | 100 | 100 | 100 | 100 | 0 | 0 | 0 |
| Detergency | | | ○ | ○ | ○ | ○ | ○ | ○ | ○ | ○ | X | X | X |
| Softening ability | | | ○ | ○ | ○ | ◎ | ◎ | ◎ | ○ | ◎ | ○ | Δ | Δ |

Components in Table 1 are those shown below.

a1: Glycerin monoether represented by formula (I) in which R is an alkyl group having 12 to 14 carbon atoms and n is 3.

a2: Glycerin monoether represented by formula (I) in which R is an alkyl group having 12 to 14 carbon atoms and n is 4.

a3: Glycerin monoether represented by formula (I) in which R is an alkyl group having 12 to 14 carbon atoms and n is 5.

a4: Glycerin monoether represented by formula (I) in which R is an alkyl group having 12 to 14 carbon atoms and n is 2.

a5: Glycerin monoether represented by formula (I) in which R is an alkyl group having 12 to 14 carbon atoms and n is 1.

a6: Glycerin monoether represented by formula (I) in which R is an alkyl group having 12 to 14 carbon atoms and n is 6.

a7: Glycerin monoether represented by formula (I) in which R is an alkyl group having 12 to 14 carbon atoms and n is 7.

Clay mineral 1: "Round Rosyl DGA212" (manufactured by Zude Chemi Company, bentonite granules, Na/Ca ratio: 2.545)

Clay mineral 2: "Round Rosyl PR414" (manufactured by Zude Chemi Company, bentonite granules, Na/Ca ratio: 0.833)

Clay mineral 3: "Bengel Bright 23" (manufactured by Hojun Company, bentonite powder, Na/Ca ratio: 2.27)

Clay mineral 4: "Bengel Bright 11" (manufactured by Hojun Company, bentonite powder, Na/Ca ratio: 0.025)

Ethoxylate nonion: One obtained by adding an average of 6 mol of ethylene oxide to a primary alcohol having 10 to 14 carbon atoms.

LAS: Sodium straight-chain alkylbenzenesulfonate with an alkyl group having 12 to 14 carbon atoms.

α-SFE: One obtained by sulfonating a fatty acid methyl ester having 14 to 18 carbon atoms.

AS: Sodium alkylsulfate having 12 to 15 carbon atoms.

Crystalline silicate: Prefeed granular product (manufactured by Tokuyama Siltech Co., Ltd).

Soap: Fatty acid salt having 12 to 20 carbon atoms.

PEG: Polyethylene glycol (weight average molecular weight: 10000).

Zeolite: "Zeobuilder" (manufactured by Zeobuilder Company, median diameter: 3.0 μm).

Oligomer D: Polyacrylic acid (average molecular weight: 15000; measured by GPC, based on polyethylene glycol).

Enzyme: Using "Cellulase K" (described in the publication of JP-A No. 63-264699), "Cannase24TK" (manufactured by Novozyme Company) and "Sabinase 6.0T" (manufactured by Novozyme Company) in a ratio by weight of 3/1/2).

(a)/A×100 in Table 1 shows the ratio by weight of (a) including a1, a2 and a3 to glyceryl monoether A (degree n of condensation=1 to 7).

The invention claimed is:

1. A softening detergent composition, comprising:

(a) a glyceryl monoether comprising a hydrocarbon group having 6 to 22 carbon atoms and a glycerin condensation degree (n) of 1 to 7, wherein i) 40% or more by weight of the total amount of glyceryl monoether has a glycerin condensation degree (n) of 3 to 5;

ii) less than 20% by weight of the total amount of glyceryl monoether has a glycerin condensation degree (n) of 1 or 2; and iii) less than 10% by weight of the total amount of glyceryl monoether has a glycerin condensation degree (n) of 1;

(b) a clay mineral; and (e) a fatty acid salt.

2. The softening detergent composition of claim 1, wherein the content of component (a) is 0.1 to 80% by weight.

3. The softening detergent composition of claim 1 or 2, wherein the content of component (b) is 3 to 30% by weight.

4. The softening detergent composition of claim 1 or 2, comprising a surfactant other than component (a), wherein the ratio by weight of component (a)/all surfactants is 1/10 to 1/1.

5. The softening detergent composition of claim 1 or 2, wherein component (a) is a compound in which $C_3H_6O_2$ groups are linearly bound with each other.

6. The softening detergent composition of claim 1 or 2, wherein the hydrocarbon group is a straight-chain alkyl group.

7. The softening detergent composition of claim 1 or 2, wherein component (b) is a smectite type clay mineral.

* * * * *